US009227292B2

(12) United States Patent
Hawrylko et al.

(10) Patent No.: US 9,227,292 B2
(45) Date of Patent: Jan. 5, 2016

(54) SYSTEM OF FINISHING A PART FORMED OF SEVERAL MATERIALS

(71) Applicant: Comadur S.A., Le Locle (CH)

(72) Inventors: Jean-Mary Hawrylko, Valdahon (FR); Hubert Gauthier, Fournets-Luisans (FR)

(73) Assignee: Comadur S.A., Le Locle (CH)

( * ) Notice: Subject to any disclaimer, the term of this patent is extended or adjusted under 35 U.S.C. 154(b) by 108 days.

(21) Appl. No.: 13/908,175

(22) Filed: Jun. 3, 2013

(65) Prior Publication Data

US 2013/0331007 A1 Dec. 12, 2013

(30) Foreign Application Priority Data

Jun. 7, 2012 (EP) ..... 12171178

(51) Int. Cl.

| | |
|---|---|
| ***B24B 31/116*** | (2006.01) |
| ***B24B 31/06*** | (2006.01) |
| ***B24B 31/00*** | (2006.01) |
| ***B24B 31/12*** | (2006.01) |
| ***B24B 41/00*** | (2006.01) |
| ***B24B 41/02*** | (2006.01) |

(52) U.S. Cl.

CPC ..... *B24B 31/116* (2013.01); *B24B 31/003* (2013.01); *B24B 31/064* (2013.01); *B24B 31/12* (2013.01); *B24B 41/005* (2013.01); *B24B 41/02* (2013.01)

(58) Field of Classification Search

CPC ..... B24B 31/00; B24B 31/003; B24B 31/06; B24B 31/064; B24B 31/116; B24B 31/12; B24B 41/005; B24B 41/02

USPC ..... 451/32, 36, 41, 104, 106, 327

See application file for complete search history.

(56) References Cited

U.S. PATENT DOCUMENTS

| | | | | |
|---|---|---|---|---|
| 3,013,365 | A * | 12/1961 | Ford | 451/32 |
| 3,728,821 | A * | 4/1973 | Perry | 451/36 |
| 5,125,191 | A * | 6/1992 | Rhoades | 451/36 |
| 6,210,258 | B1 * | 4/2001 | Malkin et al. | 451/74 |
| 6,273,787 | B1 | 8/2001 | Gilmore et al. | |
| 6,645,056 | B1 | 11/2003 | Gilmore et al. | |
| 2002/0007600 | A1 | 1/2002 | Gilmore et al. | |
| 2002/0009956 | A1 | 1/2002 | Gilmore et al. | |
| 2007/0254560 | A1 * | 11/2007 | Woo et al. | 451/41 |

FOREIGN PATENT DOCUMENTS

| | | | |
|---|---|---|---|
| DE | 28 57 522 | A1 | 6/1980 |
| DE | 2857522 | A1 * | 6/1980 |

(Continued)

OTHER PUBLICATIONS

French Preliminary Search report issued Oct. 15, 2012 in Europe 12171178.2, filed Jun. 7, 2012 ( with English Translation).

*Primary Examiner* — Monica Carter
*Assistant Examiner* — Marcel Dion
(74) *Attorney, Agent, or Firm* — Oblon, McClelland, Maier & Neustadt, L.L.P.

(57) ABSTRACT

A system of finishing a part includes at least two materials of different hardness, the system including at least one accommodating device, used as a container for an abrasive element and a support device including a structure to secure the part. The system further includes a mechanism to move the part closer against the abrasive element and a mechanism to move the part relative to the accommodating device along satin finish lines. The part, in one example, is a part of a timepiece.

13 Claims, 3 Drawing Sheets

(56) References Cited

FOREIGN PATENT DOCUMENTS

| | | | | |
|---|---|---|---|---|
| EP | 0 073 536 | A2 | | 3/1983 |
| EP | 0073536 | A2 | * | 3/1983 |
| EP | 1 205 281 | A2 | | 5/2002 |
| GB | 1067656 | A | * | 5/1967 |
| WO | WO 00/12648 | | | 3/2000 |

* cited by examiner

SYSTEM OF FINISHING A PART FORMED OF SEVERAL MATERIALS

This application claims priority from European Patent Application No. 12171178.2 filled Jun. 7, 2012, the entire disclosure of which is incorporated herein by reference.

FIELD OF THE INVENTION

The invention relates to a system of finishing a part formed of several materials and, more specifically, a part of this type each material of which has a different hardness.

BACKGROUND OF THE INVENTION

It is known to satin finish elements in order to improve their visual appearance. However, when the part is formed of several materials it is difficult to properly satin finish only one portion of the part. Currently, a rotating brush has to be used to manually satin finish the required portions. This leads to excessive costs and a finish which is too heterogeneous from one satin finished portion of the part to another.

SUMMARY OF THE INVENTION

It is an object of the present invention to overcome all of part of the aforecited drawbacks by proposing a system of finishing a part formed of several materials which allows one or several of the materials to be selectively satin finished with a high level of homogeneity.

The invention therefore relates to a system of finishing a part comprising at least two materials of different hardness, the system comprising at least one accommodating device used as a container for abrasive means, a support device comprising a means of securing the part, characterized in that the system further comprises a means of moving the part closer against the abrasive means, a means of moving the part relative to the accommodating device according to the required satin finish lines, characterized in that each accommodating device comprises a tank containing said abrasive means in powder form and in that the tank is elastic so as to adapt the level of powder in the tank relative to the force imposed by the means of moving the part closer.

It is therefore clear that the directions of the satin finish lines are obtained directly from the means of relative movement of the finishing system. Consequently, the time required to satin finish the zones is always the same regardless of the number of zones to be satin finished on the same part and the lines are perfectly homogeneous in relation to each other.

In accordance with other advantageous features of the invention:

- the particles have a diameter of between 0.3 mm and 1 mm;
- the abrasive means is formed from silica and/or corundum and/or pumice and/or diamond and/or nitrides and/or carbides and/or alumina;
- each accommodating device further includes a means of vibrating the tank to renew the top layer of the abrasive means when the means of moving the part closer moves the part away from said abrasive means;
- the means of moving the part closer includes an actuator for pressing the part against the abrasive means;
- the actuator of the means of moving the part closer exerts a force of between 1 kg and 5 kg;
- the means of relative movement comprises a motor allowing the part to impart a back and forth motion against the abrasive means along said required satin finish lines;

- the back and forth motion against the abrasive means is linear or concentric;
- the system comprises at least two accommodating devices in order to renew said abrasive means of one of the accommodating devices when the other device is being used to finish said part;
- said at least two devices are mounted on a plate moveable via a carriage to selectively position one of said at least two devices opposite the support device.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

The part formed of several materials according to the invention may in particular be integrated in or equally form all or part of the external part of a timepiece. Thus, it could form all or part of a case, bracelet, bezel, dial, crystal, push button and/or crown. It may also be integrated in or make up parts formed of several materials for a timepiece movement such as, for example, a bridge and/or a plate and/or an oscillating weight.

In the example illustrated in FIG. 1, the explanation of the invention will be given with reference to an annular body 3 including inlaid decorations 5, 7, 9, 11, 13 forming the scales of a bezel 1. Thus, bezel 1 includes a body 3 made of a first material which is inlaid with at least one decoration 5, 7, 9, 11, 13 made of one or several other materials. Bezel 1 is intended to form a part that is very resistant to wear, whose visual quality is improved, particularly in terms of contrast.

Figure 1:
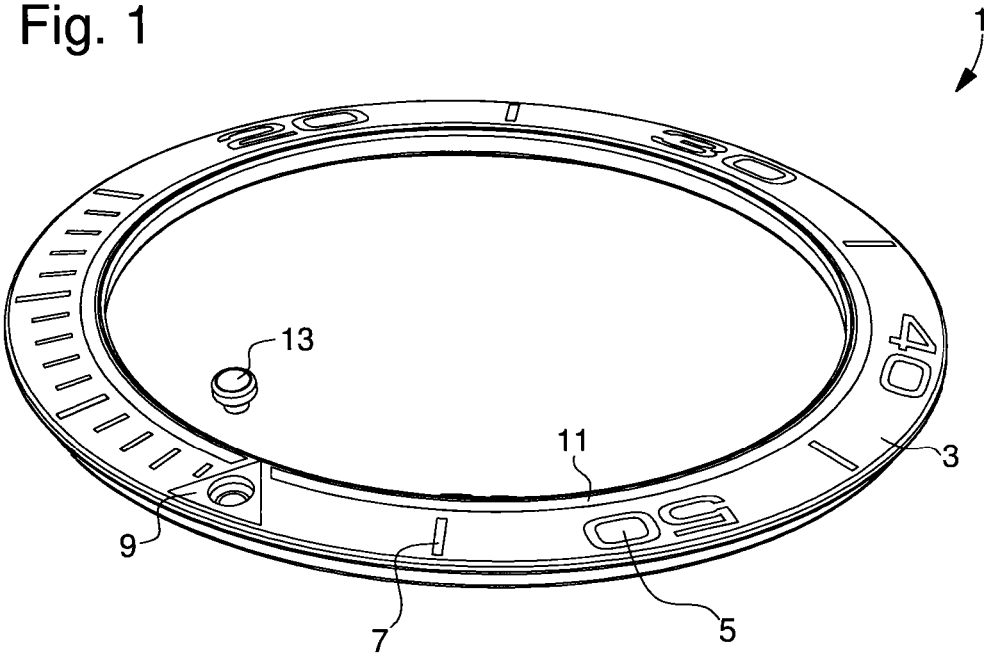
FIG. 1 is an example application of a part formed of several materials.

As illustrated in FIG. 1, it is seen that advantageously according to the invention, each decoration may take any form, such as, for example, a geometrical FIG. 7, 9, 11, an alphanumerical character 5, or even a phosphorescent indicator 13.

Body 3 is preferably made of a first hard material, i.e. having a hardness of more than 800 Hv, such as for example a ceramic. The first material may, for example, include an aluminium, titanium, zirconium or silicon based oxide, carbide or nitride to form all or part of body 3. Of course, other hard materials may be envisaged.

Preferably, according to the invention, the second material or the other materials used for decorations 5, 7, 9, 11, 13 are of lower hardness than the first material. Thus, advantageously, the invention relates to a system 21 of finishing this type of part 1, each material of which has a different hardness. System 21 advantageously satin finishes the material or materials having the lowest hardness without modifying the appearance of the material having the highest hardness. Thus, in a non-limiting manner, the other less hard materials may be a composite ceramic, glass, enamel, metal or a metal alloy.

However, it is clear that the hardest material could be that or those of decorations 5, 7, 9, 11, 13 and not that of body 3, as will be explained below.

According to the invention, finishing system 21 comprises at least one accommodating device 23, 23', used as a container for abrasive means 20 and a support device 25 comprising a means 22 of securing part 1. Moreover, system 21 further includes a means 27 of moving part 1 closer against said abrasive means 20 and means 29 of relative movement of part 1 with respect to accommodating device 23 along the required satin finish lines.

Figure 3:
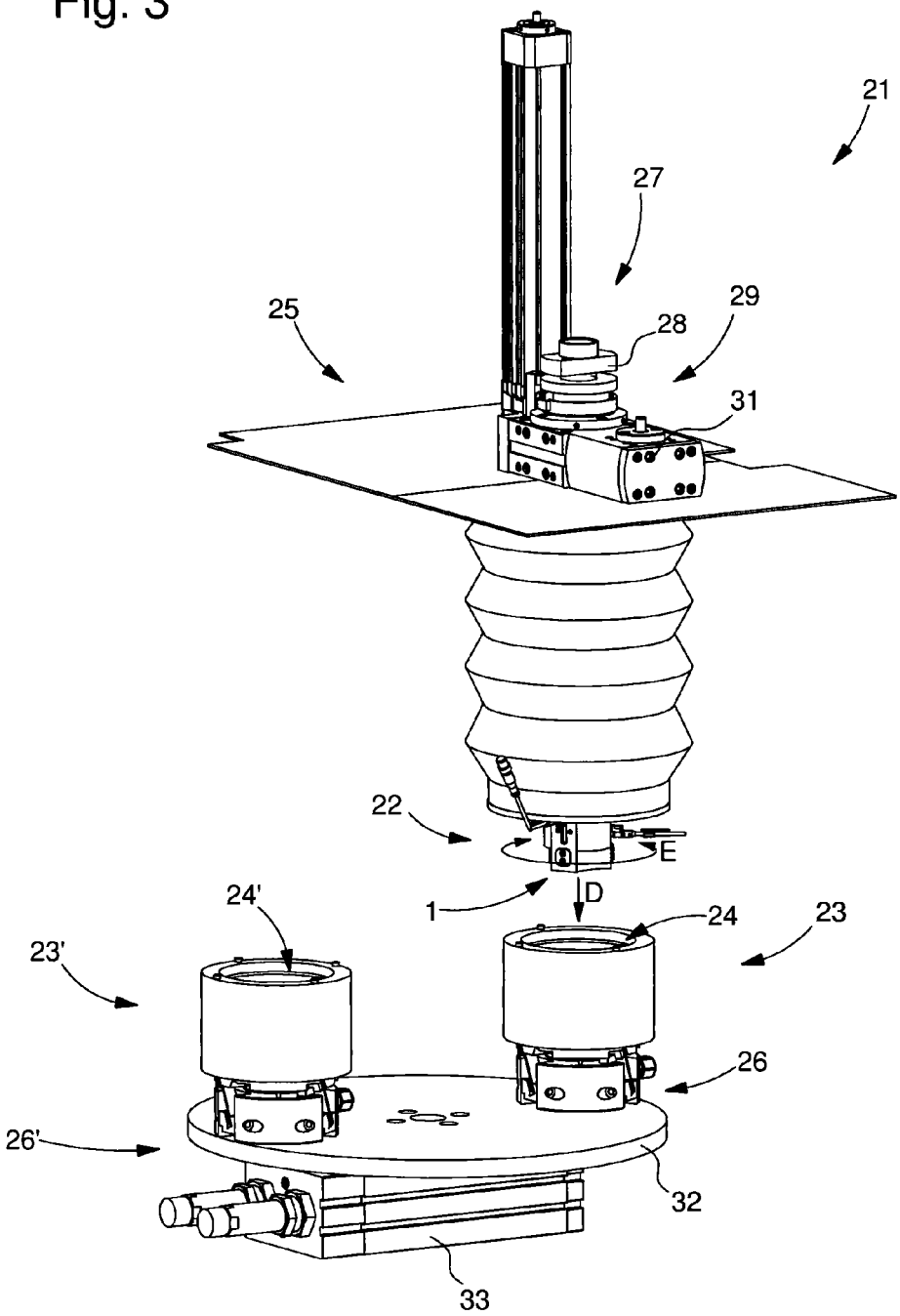
FIG. 3 is a perspective view of a finishing system according to the invention.

Advantageously according to the invention, the means 27 of moving the part closer and the means 29 of relative movement may be mounted equally on the support device 25 or on accommodating device 23. In the example of FIG. 3, means 27 of moving the part closer and means 29 of relative movement are mounted on support device 25.

Each accommodating device 23, 23' comprises a tank 24, 24' containing said abrasive means 20 in powder form into which means 27 of moving the part closer at least partially dips part 1.

Preferably, the powder of abrasive means 20 is formed by particles whose hardness is higher than the material(s) to be satin finished but lower than the material(s) to be left intact. Preferably, part 1 will therefore be polished prior to finishing using system 21. It is clear that only one portion of part 1 will have its surface state modified, i.e. at least one of the materials used will not be surface modified. By way of example, the particles, whose diameter may be comprised between 0.3 mm and 1 mm, may be formed from silica and/or corundum and/or pumice and/or diamond and/or nitrides and/or carbides and/or alumina.

As explained above, means 27 of moving the part closer exerts a sufficient force to dip one portion of part 1 into the powder of abrasive means 20. Preferably, according to the invention, tank 24, 24' is elastic so as to adapt the level of powder in tank 24, 24' relative to the force imposed by means 27 of moving the part closer. Tank 24, 24' thus exerts a counter-force B intended to press powder 20 between tank 24, 24' and part 1. Indeed, during development of system 21, it was demonstrated that a rigid tank allowed the powder to move and cover part 1 rendering the finish imperfect. It is thus clear that, because of elastic tank 24, 24', powder 20 advantageously does not cover all of part 1 even when stressed by means 27 of moving the part closer, guaranteeing an optimum finish.

Further, with each finishing operation, after polishing part 1, the particles of abrasive means 20 are blunt. This is why, advantageously according to the invention, each accommodating device 23, 23' further includes a means 26, 26' of vibrating tank 24, 24' to renew the top layer of powder when means 27 of moving the part closer moves part 1 away from abrasive means 20. Indeed, the diameter of the particles in the top layer present in tank 24, 24' which have participated in the finishing has decreased. Consequently, during vibrations C, these smaller particles are mechanically moved towards the bottom of tank 24, 24'. Thus, it is clear that the powder at the surface is replaced by particles of larger diameter, i.e. which have not been blunted.

Figure 4:
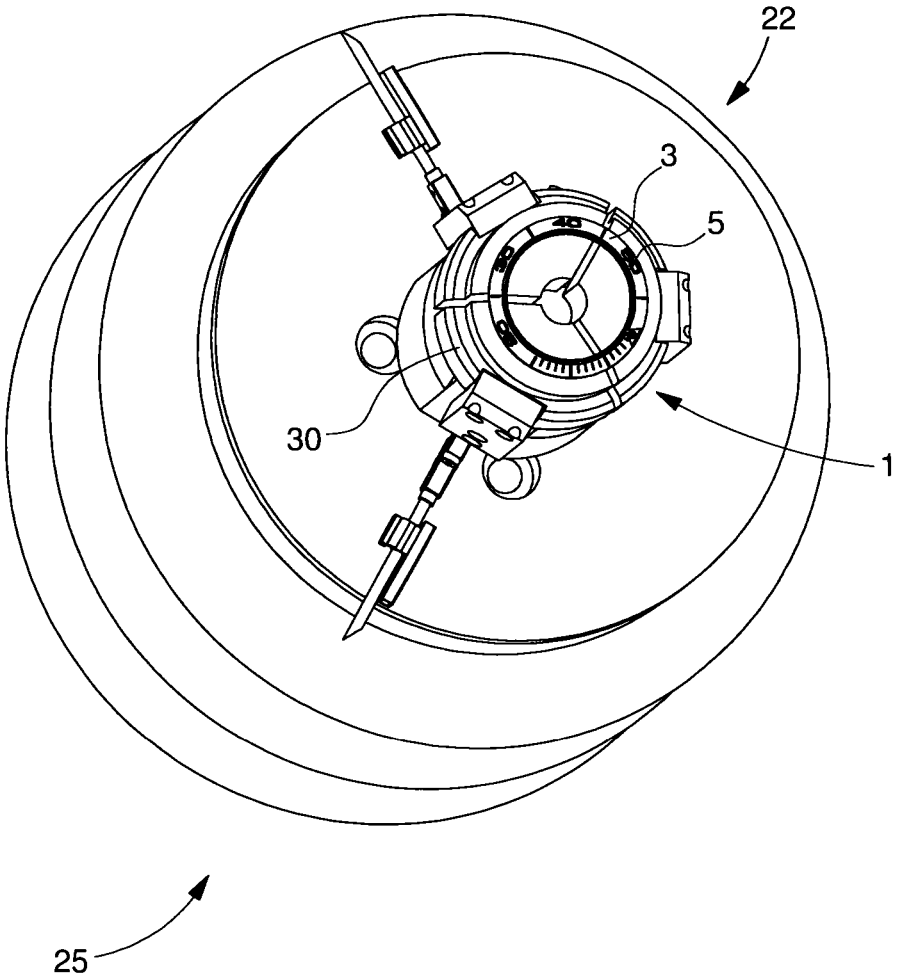
FIG. 4 is a perspective view of a support device according to the invention.

In the example illustrated in FIG. 4, the means 22 of securing support device 25 includes a fastening 30 formed of three moveable fingers moving closer to each other to hold a part 1. This fastening 30 is mechanically connected to means 27 of moving the part closer. Preferably, means 27 of moving the part closer includes an actuator 28 for pressing part 1 against abrasive means 20 in direction D in order to provide a force A against abrasive means 20 necessary for the finishing operation. Preferably, actuator 28 exerts a force comprised between 1 and 5 kg.

Figure 2:
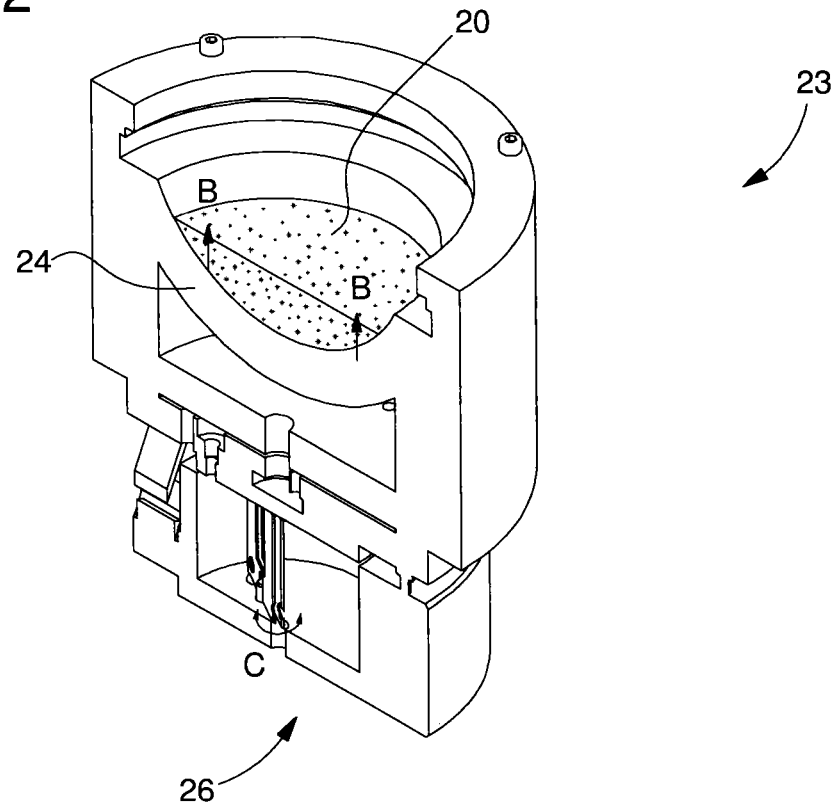
FIG. 2 is a cross-section of a accommodating device according to the invention.

Finally, in the example illustrated in FIG. 2, means 29 of relative movement comprises a motor 31, which may belong to actuator 28 of means 27 of moving the part closer, allowing the part to impart a back and forth motion E against abrasive means 20 along said required satin finish lines.

For an annular part 1 shown as an example in FIGS. 1 and 4, the satin finish lines will preferably be concentric. The back and forth motion E will then be alternate trigonometric and backward rotations. In fact, during development of system 21, it was demonstrated that a simple rotation made finishing more homogeneous. This back and forth motion E may be exerted over an amplitude comprised between 5 and 20 mm depending on the size of part 1. During development, it was demonstrated that, in the case of a rotating back and forth motion E, an amplitude of between 20 and 40 degrees gives a high level of satin finish homogeneity.

In light of the above explanations, it is clear that the required satin finish lines may also be linear. In such case, the motor of the relative movement means will induce a back and forth motion E in translation.

A finishing method according to the invention thus follows the following steps. In a first step, a part 1 comprising at least two materials of different hardness is fabricated and then at least one of the surfaces thereof is polished. In a second step, part 1 is mounted on fastening 30 of securing means 22, with the polished surface being intended to enter into contact with abrasive means 20. In a third step, means 27 of moving the part closer is actuated in motion D until part 1 touches abrasive means 20.

In a fourth step, means 27 of moving the part closer exerts a force between part 1 and abrasive means 20 necessary for the finishing operation. Advantageously according to the invention, abrasive means 20 in powder form is blocked by this force and the elastic counter-force B of tank 24. After the third or fourth step, means 29 of relative movement is also actuated in back and forth motion E. The fourth step may last several seconds to obtain a satisfactory satin finish.

In a fifth step, means 27 of moving the part closer and means 29 of relative movement are deactivated in order to move part 1 away from abrasive means 20. At the same time, vibrating means 26 is actuated to renew the top layer of abrasive means 20 in powder form. The fifth step may last several seconds in order to obtain a satisfactory renewal.

After the fifth step, a new cycle starts with a new part or with the same part, i.e. by starting from the first step or from the third step.

In the example seen in FIG. 3, it is noted that finishing system 21 comprises two accommodating devices 23, 23'. This embodiment is preferred to increase productivity. Indeed, as seen in FIG. 3, while a part 1 is worked on by a first accommodating device 23, the second accommodating device 23' may have its abrasive means renewed. Thus, the new cycle explained above is initiated using the carriage 33 which will move plate 32 so that the second device 23' is positioned opposite support device 25.

It is thus clear that it is possible to envisage finishing parts 1 by consecutively applying the different type of abrasive means of at least two accommodating devices 23, 23' and/or of at least two systems 21 to each part 1.

It is clear that, advantageously according to system 21 of the invention, the time necessary for satin finishing the zones is always the same regardless of the number of zones to be satin finished on the same part. Further, the lines are perfectly homogeneous in relation to each other regardless of whether they are curved or linear.

Of course, this invention is not limited to the illustrated example but is capable of various variants and alterations that will appear to those skilled in the art. In particular, it is also possible to finish parts 1 of very varied shapes, i.e. not limited to the annular shape shown in FIGS. 1 and 2, both for a timepiece element and outside the field of horology, such as for table arts, or jewellery.

Further, each system 21 may comprise more or fewer accommodating devices 23, 23' and/or more or fewer support devices 25, such embodiments remaining within the scope of the invention. By way of example, the same finishing system 21 may comprise two support devices 25 for finishing two parts simultaneously and six accommodating devices 23, 23' with three different types of abrasive means 20 used mounted on a single plate 32 moveable by a carriage 33.

Finally, the abrasive means must be adapted according to the materials used for the part. The materials are not limited to those cited in this description.

What is claimed is:

1. A system of satin finishing a part comprising at least two materials of different hardness, the system comprising:

at least one accommodating device containing an abrasive element, the abrasive element has a higher hardness than at least a first material among the at least two materials so as to form satin finish lines into the at least first material and has a lower hardness than the other material among the at least two materials so that the other material is left intact, a support device comprising a structure to secure the part, a mechanism to move the part closer against the abrasive element, a mechanism to move the part relative to the accommodating device, the relative movement forming directions of the satin finish lines, wherein each accommodating device comprises a tank containing the abrasive element in powder form and wherein the tank is elastic so that the abrasive element is blocked between the tank and the part even when the abrasive element is stressed by the mechanism to move the part closer so as to guarantee an optimum satin finish of the at least first material whereas the other material is left intact.

2. The system according to claim 1, wherein a diameter of particles of the abrasive element is comprised between 0.3 mm and 1 mm.

3. The system according to claim 1, wherein the abrasive element is formed from silica, corundum, pumice, diamond, nitrides, carbides, or alumina.

4. The system according to claim 1, wherein each accommodating device further includes a mechanism to vibrate the tank to renew the top layer of the abrasive element when the mechanism to move the part closer moves the part away from the abrasive element.

5. The system according to claim 1, wherein the mechanism to move the part closer includes an actuator to press the part against the abrasive element.

6. The system according to claim 5, wherein the actuator of the mechanism to move the part closer exerts a force of between 1 $Kg_F$ and 5 $Kg_F$.

7. The system according to claim 1, wherein the mechanism to move the part relative to the accommodating device comprises a motor allowing the part to impart a back and forth motion against the abrasive element along the satin finish lines.

8. The system according to claim 7, wherein the back and forth motion against the abrasive element is linear.

9. The system according to claim 7, wherein the back and forth motion against the abrasive element is concentric.

10. The system according to claim 1, wherein the system includes at least two accommodating devices so that while the part is worked on by a first accommodating device, a second accommodating device has its abrasive element renewed.

11. The system according to claim 10, wherein the at least two accommodating devices are mounted on a plate moveable via a carriage to selectively position one of the at least two accommodating devices opposite the support device.

12. The system according to claim 1, wherein the part is an element of an external part of a timepiece.

13. A system of satin finishing a part comprising at least two materials of different hardness, the system comprising:

at least one accommodating device containing an abrasive means, the abrasive means has a higher hardness than at least a first material among the at least two materials so as to form satin finish lines into the at least first material and has a lower hardness than the other material among the at least two materials so that the other material is left intact, a support device comprising a means for securing the part, a means for moving the part closer against the abrasive means, a means for moving the part relative to the accommodating device, the relative movement forming directions of the satin finish lines, wherein each accommodating device comprises a tank containing the abrasive means in powder form and wherein the tank is elastic so that the abrasive means is blocked between the tank and the part even when the abrasive means is stressed by the means for moving the part closer so as to guarantee an optimum satin finish of the at least first material whereas the other material is left intact.

* * * * *